US005429113A

United States Patent [19]

Fowler

[11] Patent Number: 5,429,113

[45] Date of Patent: Jul. 4, 1995

[54] WALL HEATER EXTENSION

[76] Inventor: Robert O. Fowler, 1395 Redmond Ave., San Jose, Calif. 95120

[21] Appl. No.: 132,385

[22] Filed: Oct. 6, 1993

[51] Int. Cl.[6] ..... F24H 3/00

[52] U.S. Cl. ..... 126/116 B; 126/114; 126/85 R; 454/332; 454/358

[58] Field of Search ..... 126/116 B, 114, 85 R; 454/306, 332, 330, 331, 358

[56] References Cited

U.S. PATENT DOCUMENTS

| | | | |
|---|---|---|---|
| 2,528,650 | 8/1949 | Graham | 219/39 |
| 2,602,441 | 7/1952 | Hollingsworth et al. | 126/116 B |
| 3,277,882 | 10/1966 | Rose | 126/512 |
| 3,280,815 | 10/1966 | Fernsten et al. | 126/116 B |
| 3,297,079 | 1/1967 | Blumenshine | 126/116 B |
| 3,444,854 | 5/1969 | Fraim | 126/116 B |
| 4,072,187 | 2/1978 | Lodge | 165/48 |
| 4,497,362 | 2/1985 | Teague, Jr. | 165/54 |
| 4,691,763 | 9/1987 | Kennedy | 165/54 |
| 4,850,266 | 7/1989 | Bennett | 98/39.1 |
| 4,852,470 | 8/1989 | Corriveau | 98/39.1 |

*Primary Examiner*—Carroll B. Dority
*Attorney, Agent, or Firm*—John J. Leavitt

[57] ABSTRACT

Presented is a wall heater or furnace extension structure for mounting in the space between a conventional wall furnace or heater and the ceiling of the room in which the wall furnace or heater are installed. The wall material normally found in this area of the wall is removed to expose the flue connected to the fire-box of the furnace or heater. The furnace extension structure is mounted on the wall so as to enclose the flue, draw air from the room into the space surrounding the flue, and then discharge the heated air back into the room from which it emanated.

15 Claims, 1 Drawing Sheet

WALL HEATER EXTENSION

BACKGROUND OF THE INVENTION

1. Field of the Invention

This invention relates to a gas-operated wall heater for residential and commercial installations wherein the housing of the wall heater is mounted on the surface of the wall and extends from near the floor to an horizontal plane spaced from the ceiling, and more particularly to a independently mounted auxiliary housing extension for such a gas-operated wall heater that functions to capture and direct into the room to be heated much of the heat energy that is normally lost through conventional wall heater installations.

2. Description of the Prior Art

A preliminary patentability and novelty search conducted in connection with the invention described herein revealed the existence of the United States patents listed hereinafter.

| | | |
|---|---|---|
| 4,072,187 | 4,497,362 | 4,691,763 |
| 4,850,266 | 4,852,470 | 2,528,650 |

In most conventional gas-operated wall heater installations, the fire-box of the heater structure is mounted in the wall space between two adjacent vertical studs. Appropriate metal brackets fixed to the fire-box at its top and bottom ends retain the fire-box suspended in the space between the studs, and retain the fire-box spaced from combustible wall materials. Conventionally, the wall material that covers the studs is so called "dry-wall", also known as "plasterboard" or "sheetrock". Such wall covering normally is cut away between the two opposing studs in the area within which the fire-box of the wall heater is mounted, but the wall material usually covers the space between the ceiling and the top end of the fire-box where the fire-box is connected to a flue, the latter extending upwardly between the two opposing wall surfaces above the wall heater, passing through the attic if any there be, and including a vent portion that extends through the roof of the building, the vent usually being covered with a vent cap, commonly referred to as a "code cap".

Within the room in which the wall heater is mounted, and which it is intended the wall heater heat when operating, the fire-box is enclosed by a wall heater housing portion that is usually suspended on a projecting edge of the upper fire-box suspension bracket. The wall heater housing portion thus fits flush against the wall surface surrounding the opening in the wall within which the fire-box is mounted, and functions to protect against direct contact of the fire-box by occupants, and to circulate room air over the exterior of the fire-box and re-circulate the heated air by convection into the room to be heated. Unfortunately, in conventional wall heater installations, much of the heat generated by the gas-fired fire-box is lost through the flue to which the fire-box is connected, and passes uselessly into the attic, from whence it is dissipated to the outdoors through conventional attic ventilation openings.

I have discovered that the efficiency rating of such a conventional gas-operated wall heater may be increased significantly by capturing much of the heat that passes through the flue portion that is contained within the wall space between the top of the wall heater and the ceiling, and re-circulating this conventionally lost heat back into the room intended to be heated by the wall heater.

Accordingly, one of the objects of the present invention is the provision of a wall heater extension that encloses the flue between the top of the fire-box and the ceiling, and by convection redirects the heated air surrounding the flue back into the room.

Another object of the invention is the provision of a housing extension for a gas-operated wall heater that functions to fill the gap between the top of the conventional wall heater housing and the ceiling to thus capture the heated air surrounding the flue that passes through this space and redirects such heated air into the room.

A still further obbject of the invention is the provision of an extension for a wall heater housing that may be retrofitted to existing wall heater installations.

Conventional gas-fired wall heaters from different heater manufacturers may vary in height. Accordingly, yet another object of the invention is the provision, as an article of manufacture, of a prefabricated wall heater housing extension adapted to fill the space between the top surface of a wall heater and the ceiling thereabove, and which is equipped with at least one adjustable trim member applicable to accommodate variations in the height of the wall heaters from different manufacturers.

Yet another object of the invention is the provision of a wall heater extension that may be hingedly mounted on the wall surface above a wall heater housing to facilitate mounting above existing wall heater installations.

The invention possesses other objects and features of advantage, some of which with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the wall heater extension structure of my invention comprises a sheetmetal article of manufacture having a width and depth comparable to the width and depth of the wall heater housing in conjunction with which it is to be utilized so that following installation, the image projected is of a unitary wall heater assembly. Thus, the extension comprises a front wall plate connected by parallel side wall plates that provide depth to the structure. One of the side wall plates is provided with a re-entrant flange adapted to lie flat against the surface of the wall on which the extension is mounted, while the opposite side wall plate is provided with a hinge structure, one leaf of which projects as a flange for attachment to the associated wall surface to which the wall heater housing is attached. Means are provided for mounting on the wall structure associated with the re-entrant flange for releasably locking the extension in a closed condition in which it covers an opening in the wall material that exposes the flue to the surrounding air mass. Louvered openings are provided in the walls of the extension structure to pass air from the room to be heated into the space surrounding the flue, and to convey the now heated air out of the interior of the extension and back into the room. Means are provided applicable to the top or bottom edge portions of the extension structure to "trim" the installation to fit varying heights of wall heater housings and fill the gap between the top of the wall heater housing and the ceiling of the room in which the wall heater is installed.

DESCRIPTION OF THE PREFERRED EMBODIMENT

Figure 1:
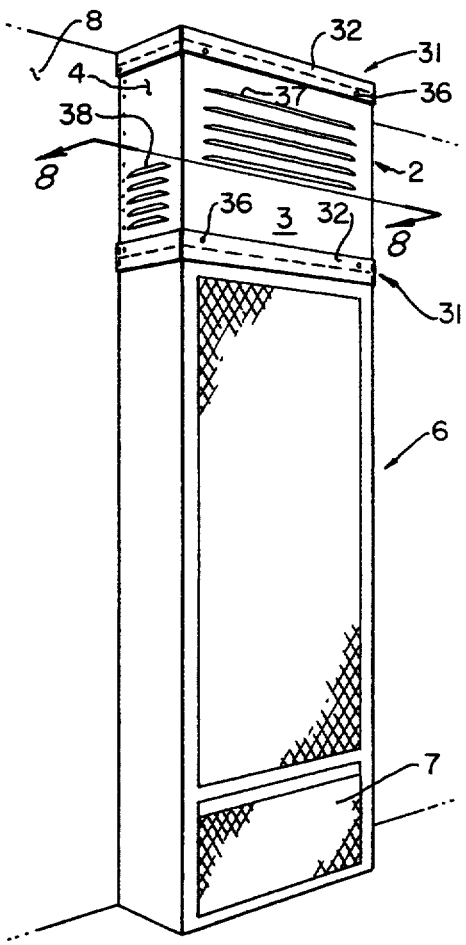
FIG. 1 is a perspective view of a completed installation, showing a conventional wall heater structure equipped with the addition of my extension structure.
Figure 3:
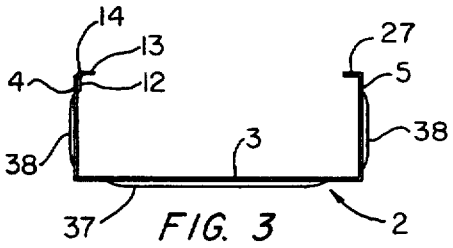
FIG. 3 is a top plan view of the extension structure of my invention, shown apart from other structure.
Figure 2:
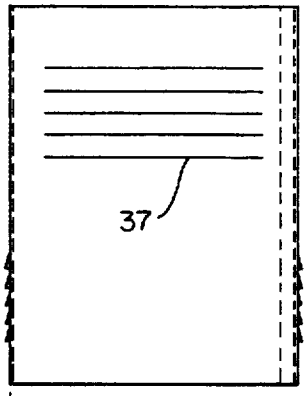
FIG. 2 is a front elevational view of my extension structure shown apart from other structure, and as viewed from the interior of the room in which it is mounted.
Figure 4:
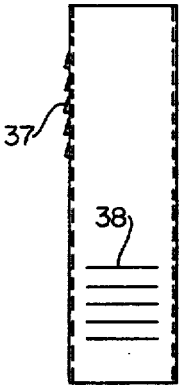
FIG. 4 is a right side elevational view of the extension structure illustrated in FIG. 2.
Figure 5:
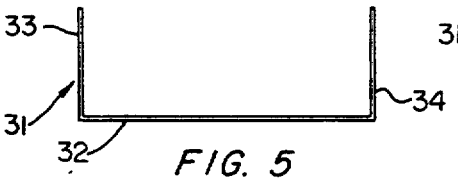
FIG. 5 is a plan view of a trim member adapted to be applied to the extension member to fill any gaps that might occur because of variations in the height of the wall heater to which the extension structure is applied.
Figure 7:
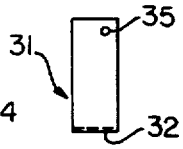
FIG. 7 is a right side elevational view of the trim member illustrated in FIG. 5.
Figure 6:
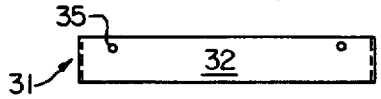
FIG. 6 is a bottom plan view of the trim member illustrated in FIG. 5.

In terms of greater detail, and referring to the drawings, it will be seen that the energy efficient wall heater extension structure of my invention is designated generally by the numeral 2, and is formed as a unitary sheet-metal structure having a front face plate 3 preferably integral with perpendicular side wall plates 4 and 5 that are of the same height as the front face. The overall height of the extension structure may range from 21" to 23", and this range has been found to be essentially universally applicable for most conventional wall heaters, here designated generally by the numeral 6, which have a generally standard height of about 72½" measured from the floor. As shown in the drawing, conventional wall heaters are also provided with an access door 7 that provides access to the gas control valve (not shown). Side wall plates 4 and 5 have a width of approximately 6", thus conforming the depth of the extension structure to the depth of most conventional wall heater housings.

Figure 8:
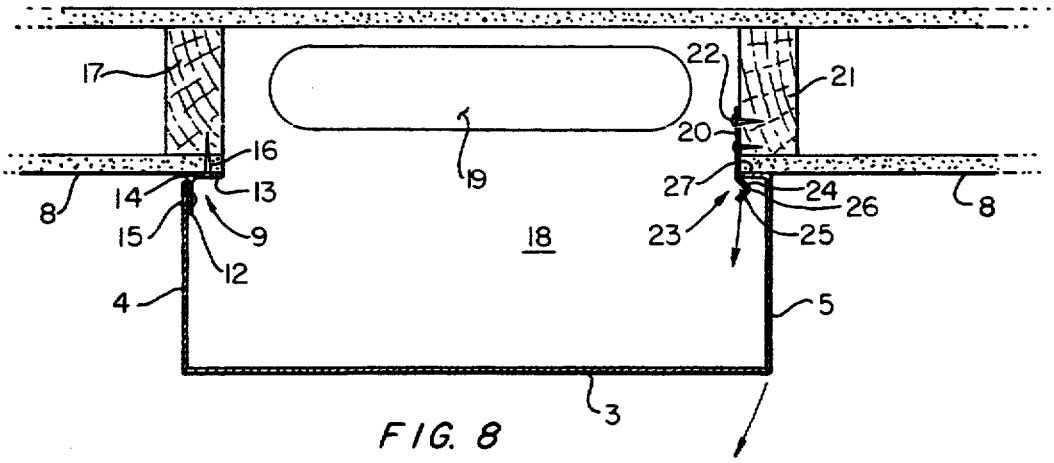
FIG. 8 is a horizontal cross-sectional view taken in the plane indicated by the line 8—8 in FIG. 1, showing the extension structure mounted on a wall surface in operative association with a flue member.

To mount the housing extension 2 to the associated wall 8, the side plate 4 is provided with a hinge structure designated generally by the numeral 9. The hinge structure is preferably of the piano hinge type with two leaves 12 and 13 pivoted on a pintle 14. The hinge leaf 12 is secured to the free edge portion 15 of the side plate 4 as shown in FIG. 8, and the leaf 13 is provided with apertures (not shown) through which nails or mounting screws 16 are driven into the underlying wall structure, including the wall stud 17, so as to securely retain the housing extension pivotally mounted on the face of the wall 8. As illustrated in FIG. 8, the housing extension structure may be swung away from the wall surface 8 in the direction indicated by the arrow, so as to provide access to the interior wall space 18 within which the flue 19 is supported as previously described. Such access is important for inspection purposes because it enables inspection to ensure that the flue is properly connected to the fire-box of the wall heater, and that appropriate spacers and header and base plates are properly installed to retain the fire-box and flue in proper position spaced from flammable material. It should also be apparent that since there is no sheetrock or wall covering material on the area of wall covered by the housing extension, the housing extension, when closed as illustrated in FIG. 8, obviates the necessity of providing sheetrock, taping of joints, texturing of the sheetrock and painting, thus saving considerable expense in new construction where wall heaters equipped with housing extensions according to my invention are installed.

Referring again to FIG. 8, it is there seen that when the housing extension 2 is closed, as shown, it is releasably held closed by a spring clip 20 secured to the wall stud 21 by appropriate screws or nails 22 as shown. The spring clip is provided with an extension that projects past the wall surface 8, and the spring clip extension is provided with a laterally offset portion 23 having two diverging cam surfaces 24 and 25 that join in an apex 26 that projects laterally past the edge of the re-entrant flange 27 provided on the side plate 5 as shown. Thus, when the housing extension 2 is pivoted clockwise as seen in FIG. 8, to open the housing, the edge of the re-entrant flange engages the cam surface 24 and causes the projecting portion 23 to be resiliently displaced inwardly until the edge of the flange slides past the apex 26 of the extension portion. Conversely, when it is desired to close the open housing extension, pivoting the housing extension counterclockwise causes the edge of the re-entrant flange to engage the cam surface 25, again resiliently displacing the spring clip portion 23 inwardly until the edge of the flange slides past the apex and the flange 27 lies flat against the surface of the wall 8, resiliently held closed by cam surface 24.

As explained above, not all gas-fired wall heaters are of exactly the same height. Different wall heater manufacturers frequently set their own standards for height, and these differences in height must be accommodated. Accordingly, my invention includes a trim member designated generally by the numeral 31 and illustrated in FIGS. 1, 5, 6 and 7. As there shown, the trim member 31 comprises a sheet metal strip formed to provide a front face plate 32 and perpendicular side plates 33 and 34 corresponding in depth to the depth of the side plates 4 and 5 of the wall heater housing 2. Apertures 35 are provided in the face plate of the trim member to receive self-tapping screws 36, utilized to fasten the trim member to the top and/or bottom edge portion of the housing extension in a manner so that the trim member fits snugly against the ceiling as shown in FIG. 1. Screw receiving apertures may also be formed in the side plates 33 and 34 so that the free ends of the side plates may be secured to the side plates 4 and 5. It should be noted that in FIG. 1 two such trim members are illustrated. It should also be noted that the two trim members are identical and reversible so that each trim member may be applied to fit either the top of the housing extension or the bottom thereof, as shown.

To enable the passage of air from the room being heated into the space 18 surrounding the flue 19, the front plate 3 of the housing extension and the side plates 33 and 34 are provided with louvers 37 and 38 associated with elongated slots formed in the associated front and side plates, respectively. Thus, air enters the slots associated with the side plate louvers 38, enters the space surrounding the flue, is heated, and rises to pass out of the housing extension through the slots associated with the louvers 37 to thus be discharged into the room to be heated.

Having thus described the invention, what is believed to be new and novel and sought to be protected by letters patent of the United States is as follows.

I claim:

1. As an article of manufacture, a wall heater extension adapted to be mounted on a wall between a conventional wall-mounted gas-fired wall heater and a room ceiling thereabove and adapted to heat the air in the room in which it is installed and effective for drawing heat energy from a flue carrying hot products of combustion from the gas-fired wall heater and distributing such heat energy into the room to be heated by the wall heater, said article of manufacture comprising:

a) a sheetmetal housing extension having front and side plates forming an enclosure about the flue when installed between a wall heater and the ceiling of the room in which the wall heater is installed, and b) means on the sheetmetal housing extension for drawing air from the room into the housing extension so as to surround and be heated by the hot flue and then discharged back into the room from which it emanated, whereby the heating efficiency of the wall heater with which the housing extension is cooperatively associated is increased.

2. The article of manufacture as defined in claim 1, wherein said means for admitting room air into the space surrounding the flue comprises a multiplicity of louvered slots formed in the side plates of the sheetmetal housing extension.

3. The article of manufacture as defined in claim 2, wherein one of said side plates is provided with a hinge structure for mounting the wall heater extension to the wall and in position when closed to enclose an associated flue rising from the conventional wall heater, and selectively pivotally openable to enable inspection of the wall heater and flue installation.

4. The article of manufacture as defined in claim 1, wherein means are provided associated with one of said side plates for releasably retaining the wall heater housing extension in a closed condition to form an enclosure about the flue above the wall heater.

5. The article of manufacture as defined in claim 1, wherein at least one trim member is provided for selective attachment to the wall heater extension to seal the space therebetween and a wall heater above which the wall heater extension is mounted and between the associated ceiling of the room and the wall heater extension.

6. In combination, a primary wall furnace of the gas-fired type having a fire-box within which hot products of combustion are generated when the furnace is operating and a flue connected to the fire-box and extending above the wall furnace for conduction of hot products of combustion out of the fire-box and into the atmosphere and adapted when operating to heat a room in which it is installed, and a wall furnace auxiliary structure independently mounted in association with the wall furnace flue and adapted to draw air from the room to be heated into the space surrounding the flue to thereby draw heat energy by convection from the flue and distribute such heat energy into the room to be heated.

7. The combination according to claim 6, in which said room in which said wall furnace is installed has a ceiling spaced above the wall furnace, and said wall furnace auxiliary structure is mounted between the wall furnace and the ceiling.

8. The combination according to claim 7, whereinsaid wall furnace auxiliary structure includes front and side plates forming an enclosure about the flue when installed between the wall furnace and the ceiling of the room to be heated.

9. The combination according to claim 8, wherein said wall furnace auxiliary structure includes means for drawing air by convection into the space enclosed by said front and side plates and through which space said flue traverses, and means for discharging into the room to be heated hot air heated by said flue and drawn from said space enclosed by said front and side plates.

10. The combination according to claim 9, wherein said means for admitting room air into said space enclosed by said wall furnace extension structure and discharging heated air therefrom comprises a multiplicity of louvered slots formed in the side and front plates of the wall furnace auxiliary structure.

11. The combination according to claim 9, wherein at least one trim membr is provided for selective attachment to the wall furnace auxiliary structure to seal the space therebetween and a wall furnace above which the wall furnace auxiliary structure is mounted and between the associated ceiling of the room and the wall furnace auxiliary structure.

12. In combination, a wall furnace of the gas-fired type having a fire-box within which hot products of combustion are generated when the furnace is operating and a flue connected to the fire-box for conduction of hot products of combustion out of the fire-box and into the atmosphere, a wall furnace extension structure mounted in association with the wall furnace flue and adapted to draw air from the room to be heated into the space surrounding the flue to thereby draw heat energy by convection from the flue and distribute such heat energy into the room to be heated, said room having a floor, at least one wall on which said wall furnace is adapted to be installed, a ceiling spaced above the wall furnace, said wall furnace extension structure being mounted on said at least one wall between the wall furnace and the ceiling, said wall furnace extension structure including front and side plates forming an enclosure about the flue when installed between the wall furnace and the ceiling of the room to be heated, said wall furnace extension structure including means for drawing air by convection into the space enclosed by said front and side plates and through which space said flue traverses, means for discharging into the room to be heated air heated by said flue and drawn from said space enclosed by said front and side plates, one of said side plates of said wall furnace extension structure being provided with a hinge structure for pivotally mounting the wall furnace extension structure above said wall furnace.

13. The combination according to claim 12, wherein means are provided associated with one of said side plates for releasably retaining the wall heater housing extension structure in a closed condition to form an enclosure about the flue above the wall heater.

14. The combination according to claim 12, wherein at least one trim member is provided for selective attachment to the wall heater extension structure to seal the space between the wall heater above which the wall heater extension structure is mounted and the associated ceiling of the room in which the wall heater and wall heater extension structure are installed.

15. The combination according to claim 12, wherein said means for admitting room air into said space enclosed by said wall furnace extension structure and discharging heated air therefrom comprises a multiplicity of louvered slots formed in the side and front plates of the wall furnace extension structure.

* * * * *